US010971316B2

(12) United States Patent
Andersen et al.

(10) Patent No.: US 10,971,316 B2
(45) Date of Patent: Apr. 6, 2021

(54) PRESSURE TRIP UNIT FOR AN ELECTRICAL SWITCH AND ELECTRICAL SWITCH WITH SUCH A PRESSURE TRIP UNIT

(71) Applicant: Siemens Aktiengesellschaft, Munich (DE)

(72) Inventors: Oliver Andersen, Berlin (DE); Pawel Biedunkiewicz, Berlin (DE); Joerg-uwe Dahl, Werder (DE); Erhard Deylitz, Berlin (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 16/050,115

(22) Filed: Jul. 31, 2018

(65) Prior Publication Data

US 2019/0043679 A1 Feb. 7, 2019

(30) Foreign Application Priority Data

Aug. 1, 2017 (DE) ..... 102017213238.8
Jul. 18, 2018 (DE) ..... 102018211995.3

(51) Int. Cl.
*H01H 33/42* (2006.01)
*H01H 9/34* (2006.01)
(Continued)

(52) U.S. Cl.
CPC ..... *H01H 33/42* (2013.01); *H01H 9/342* (2013.01); *H01H 33/53* (2013.01); *H01H 33/82* (2013.01);
(Continued)

(58) Field of Classification Search
CPC ..... H01H 33/42; H01H 33/53; H01H 33/82; H01H 9/342; H01H 2009/348;
(Continued)

(56) References Cited

U.S. PATENT DOCUMENTS 3,631,369 A * 12/1971 Menocal ..... B60S 3/04 218/157
5,103,198 A 4/1992 Morel et al.
(Continued)

FOREIGN PATENT DOCUMENTS

CN 103021750 * 4/2013 ..... H01H 2077/025
DE 69110540 T2 2/1996
(Continued)

OTHER PUBLICATIONS

Translation CN103021750 (Original document published Apr. 3, 2013) (Year: 2013).*
(Continued)

*Primary Examiner* — William A Bolton
(74) *Attorney, Agent, or Firm* — Harness, Dickey & Pierce, P.L.C.

(57) ABSTRACT

A pressure trip unit for an electrical switch, including an actuating element and at least one flow channel per electrical pole, is disclosed. In an embodiment, the at least one pole of the electrical switch includes at least two switching contacts for making or disconnecting a flow path. The switching contacts of the at least one pole of the electrical switch are disconnectable via the actuating element which can respond to a pressure generated in a disconnection zone of the, in each case, two switching contacts by an electric arc drawn in the event of an electrodynamic recoil of the switching contacts. Further, the disconnection zone is connectable to the actuating element via the flow channel, the at least one flow channel including a nonreturn valve to permit a flow
(Continued)

only from the disconnection zone in the direction of the actuating element.

20 Claims, 9 Drawing Sheets

(51) Int. Cl.

| | |
|---|---|
| ***H01H 33/53*** | (2006.01) |
| ***H01H 33/82*** | (2006.01) |
| ***H01H 71/24*** | (2006.01) |
| ***H01H 77/02*** | (2006.01) |
| ***H01H 33/83*** | (2006.01) |
| *H01H 33/02* | (2006.01) |

(52) U.S. Cl.
CPC ..... *H01H 33/83* (2013.01); *H01H 33/022* (2013.01); *H01H 2009/343* (2013.01); *H01H 2071/2427* (2013.01); *H01H 2077/025* (2013.01)

(58) Field of Classification Search
CPC ..... H01H 2077/025; H01H 71/025; H01H 71/0271; H01H 73/18
USPC ..... 218/48, 12–14, 51, 52, 86, 88, 99, 114
See application file for complete search history.

(56) References Cited

U.S. PATENT DOCUMENTS

| | | | | |
|---|---|---|---|---|
| 5,298,874 | A | 3/1994 | Morel et al. | |
| 5,731,561 | A * | 3/1998 | Manthe | H01H 9/34 218/157 |
| 7,403,087 | B2 * | 7/2008 | Oh | H01H 77/10 335/172 |
| 8,063,334 | B2 * | 11/2011 | Dahl | H01H 9/342 218/114 |
| 8,553,385 | B2 | 10/2013 | Ahlert | |
| 9,508,511 | B2 | 11/2016 | Legendre et al. | |
| 9,887,050 | B1 * | 2/2018 | Cox | H01H 9/36 |
| 2001/0045879 | A1 * | 11/2001 | Reichard | H01H 77/02 335/172 |
| 2002/0130744 | A1 * | 9/2002 | Jodehl | H01H 77/10 335/172 |
| 2009/0194510 | A1 | 8/2009 | Dahl | |
| 2012/0314331 | A1 | 12/2012 | Ahlert et al. | |
| 2012/0318133 | A1 * | 12/2012 | Truglia | B60K 3/04 91/55 |
| 2013/0118101 | A1 * | 5/2013 | Mitchell | E06B 7/14 52/209 |
| 2013/0126316 | A1 | 5/2013 | Woodson | |
| 2014/0305780 | A1 * | 10/2014 | Coleman | H01H 9/20 200/331 |

FOREIGN PATENT DOCUMENTS

| | | | |
|---|---|---|---|
| DE | 69217441 | T2 | 7/1997 |
| DE | 102008039152 | A1 | 2/2010 |
| DE | 102009015126 | A1 | 10/2010 |
| DE | 102011077359 | A1 | 12/2012 |
| EP | 2081202 | A2 | 7/2009 |

OTHER PUBLICATIONS

Extended European Search Report dated Nov. 28, 2018.
German Office Action dated May 28, 2019.

* cited by examiner

PRESSURE TRIP UNIT FOR AN ELECTRICAL SWITCH AND ELECTRICAL SWITCH WITH SUCH A PRESSURE TRIP UNIT

PRIORITY STATEMENT

The present application hereby claims priority under 35 U.S.C. § 119 to German patent applications numbers DE 102017213238.8 filed Aug. 1, 2017 and DE 102018211995.3 filed Jul. 18, 2018, the entire contents of each of which are hereby incorporated herein by reference.

FIELD

At least one embodiment of the invention generally relates to a pressure trip unit for an electrical switch, and/or to an electrical switch comprising such a pressure trip unit.

BACKGROUND

Typically, current-limiting switchgears, in particular current-limiting circuit breakers, for example in the form of MCCBs (Molded Case Circuit Breakers), are used in extensively branched power distribution networks. It is customary to conduct selective staggering with a minimum nominal current distance between the switchgears involved. Each branching plane can be protected here against overloads and short circuits that occur by a switchgear which is appropriately dimensioned depending on the connected consumers.

For example, a switchgear which is arranged closest to a consumer and which is often referred to as a consumer-close or downstream switchgear, is configured for the lowest nominal current. If a short circuit current then flows both through the consumer-close switchgear and through a switchgear which is arranged above the consumer-near switchgear in the hierarchy of the power distribution network and is often referred to as a consumer-remote or upstream switchgear, only the consumer-near switchgear is intended to switch off. In other words, in the event of a malfunction (short circuit), only the switchgear which is closest to the event is intended to break the current flow.

Upon opening, the switching contact pairs of the consumer-close and of the consumer-remote switchgear draw an electric arc, wherein the opening width of the switching contact pairs and also the electric arc energy are higher in the case of the consumer-close switchgear because of the lower mass moment of inertia of its movable current path including the switching contact. This opening, which, under some circumstances, is only a single-pole opening, has to be followed by an all-pole switching off of the consumer-close switchgear. The consumer-remote switchgear must not switch off so as not to disconnect further consumers from the power distribution network. However, the consumer-remote switchgear must act in an assisting manner by brief raising of the switching contacts, i.e. must contribute, for example, to the switching off of the consumer-close switchgear by limiting the current.

Switchgears which act in such a staggered manner in power distribution networks behave selectively. In order to achieve this selectivity, the switchgears lying closest to the malfunction have to break the current paths of all of the switching poles more rapidly than the switchgears arranged thereabove.

DE 691 10 540 T2 and DE 692 17 441 T2 each disclose electrical switching arrangements in the form of circuit breakers with insulating material housings, which, per switching pole, comprise two switching contacts which are pressed resiliently against each other in the switching-on position of the circuit breaker. The switching contacts can be disconnected by the action of electrodynamic recoil forces if the current flowing through the switching contacts exceeds a certain threshold value, in order thereby to bring about a limiting of the current mentioned.

The circuit breaker disclosed in the documents comprises an overload and/or short circuit detection element for acting upon a switching off mechanism which brings about the automatic switching off of the circuit breaker in the event of a fault. Furthermore, the circuit breaker disclosed in the documents comprises an actuating element which responds to a positive pressure generated in the disconnection zone of the switching contacts by way of an electric arc drawn in the event of an electrodynamic recoil of the switching contacts, in order to actuate the switching off mechanism of the circuit breaker.

The actuating element disclosed in the documents is a gas-tight unit which is connected exclusively to the disconnection zone of the switching contacts and comprises a movable element, for example a piston or a membrane, with a limited control stroke. The movable element is acted upon firstly with the positive pressure and secondly by a restoring device with adapted active force. The displacement of the movable element brings about the tripping of the switching off mechanism of the circuit breaker, wherein the restoring device with adapted active force is dimensioned such that an undesirable tripping in the event of a simple overload or a response of a downstream, current-limiting circuit breaker is prevented.

Further pressure trip units are likewise disclosed in the documents DE 10 2009 015 126 A1 and DE 10 2011 077 359 A1.

SUMMARY

At least one embodiment of the invention specifies an alternative pressure trip unit.

At least one embodiment of the invention is directed to a pressure trip unit. Advantageous refinements of the pressure trip unit are specified in the embodiments. At least one embodiment of the invention is directed to an electric switch. Advantageous refinements are specified in the embodiments.

The pressure trip unit for an electrical switch of at least one embodiment comprises an actuating element and at least one flow channel per electrical pole, wherein the at least one pole of the electrical switch comprises at least two switching contacts for making or disconnecting a flow path, wherein the switching contacts of the at least one pole of the electrical switch are disconnectable by way of the actuating element which can respond to a pressure which is generated in a disconnection zone of the in each case two switching contacts by an electric arc drawn in the event of an electrodynamic recoil of the switching contacts, and wherein the disconnection zone is connectable to the actuating element via the flow channel, wherein the at least one flow channel comprises a nonreturn valve which permits a flow only from the disconnection zone in the direction of the actuating element.

The electrical switch comprising a plurality of poles of at least one embodiment comprises a pressure trip unit according to at least one embodiment of the invention, wherein the plurality of poles of the electrical switch each comprise at least two switching contacts for making or disconnecting a flow path, wherein the switching contacts of the plurality of poles of the electrical switch are disconnected by way of the actuating element which responds to a pressure which is generated in a disconnection zone of the respective two switching contacts by an electric arc drawn in the event of an electrodynamic recoil of the switching contacts, and wherein the disconnection zones are connected to the actuating element via the flow channels.

BRIEF DESCRIPTION OF THE DRAWINGS

The above-described properties, features and advantages of this invention, and the manner in which they are achieved, will become clearer and more clearly comprehensible in conjunction with the description below of the example embodiments which will be explained in more detail in conjunction with the figures.

In the figures.

DETAILED DESCRIPTION OF THE EXAMPLE EMBODIMENTS

Figure 1:
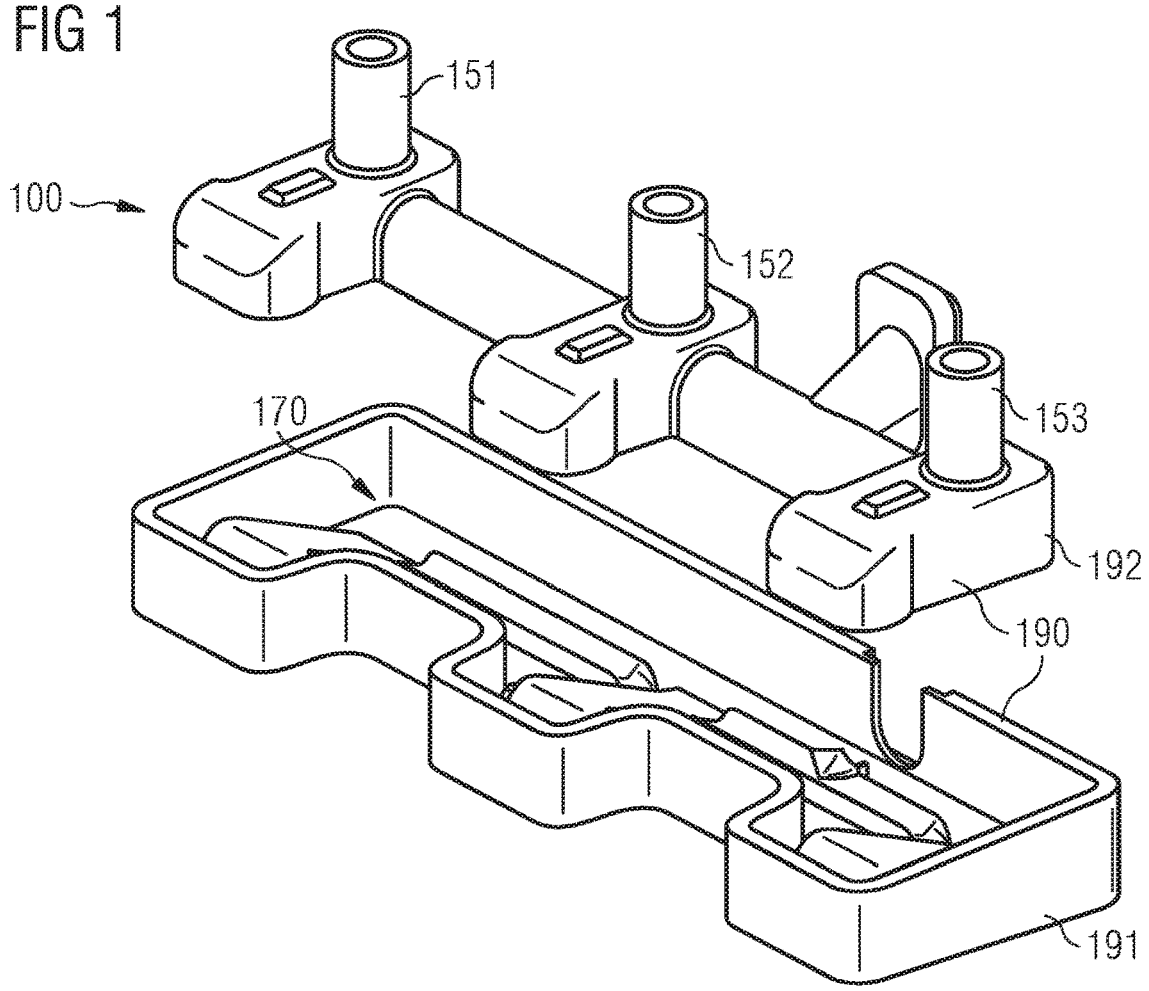
FIG. 1 shows a pressure trip unit with a first housing part and a second housing part.

In the following, embodiments of the invention are described in detail with reference to the accompanying drawings. It is to be understood that the following description of the embodiments is given only for the purpose of illustration and is not to be taken in a limiting sense. It should be noted that the drawings are to be regarded as being schematic representations only, and elements in the drawings are not necessarily to scale with each other. Rather, the representation of the various elements is chosen such that their function and general purpose become apparent to a person skilled in the art.

The drawings are to be regarded as being schematic representations and elements illustrated in the drawings are not necessarily shown to scale. Rather, the various elements are represented such that their function and general purpose become apparent to a person skilled in the art. Any connection or coupling between functional blocks, devices, components, or other physical or functional units shown in the drawings or described herein may also be implemented by an indirect connection or coupling. A coupling between components may also be established over a wireless connection. Functional blocks may be implemented in hardware, firmware, software, or a combination thereof.

Various example embodiments will now be described more fully with reference to the accompanying drawings in which only some example embodiments are shown. Specific structural and functional details disclosed herein are merely representative for purposes of describing example embodiments. Example embodiments, however, may be embodied in various different forms, and should not be construed as being limited to only the illustrated embodiments. Rather, the illustrated embodiments are provided as examples so that this disclosure will be thorough and complete, and will fully convey the concepts of this disclosure to those skilled in the art. Accordingly, known processes, elements, and techniques, may not be described with respect to some example embodiments. Unless otherwise noted, like reference characters denote like elements throughout the attached drawings and written description, and thus descriptions will not be repeated. The present invention, however, may be embodied in many alternate forms and should not be construed as limited to only the example embodiments set forth herein.

It will be understood that, although the terms first, second, etc. may be used herein to describe various elements, components, regions, layers, and/or sections, these elements, components, regions, layers, and/or sections, should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items. The phrase "at least one of" has the same meaning as "and/or".

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below," "beneath," or "under," other elements or features would then be oriented "above" the other elements or features. Thus, the example terms "below" and "under" may encompass both an orientation of above and below. The device may be otherwise oriented (rotated 90 degrees or at other orientations) and the spatially relative descriptors used herein interpreted accordingly. In addition, when an element is referred to as being "between" two elements, the element may be the only element between the two elements, or one or more other intervening elements may be present.

Spatial and functional relationships between elements (for example, between modules) are described using various terms, including "connected," "engaged," "interfaced," and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. In contrast, when an element is referred to as being "directly" connected, engaged, interfaced, or coupled to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Also, the term "exemplary" is intended to refer to an example or illustration.

When an element is referred to as being "on," "connected to," "coupled to," or "adjacent to," another element, the element may be directly on, connected to, coupled to, or adjacent to, the other element, or one or more other intervening elements may be present. In contrast, when an element is referred to as being "directly on," "directly connected to," "directly coupled to," or "immediately adjacent to," another element there are no intervening elements present.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Before discussing example embodiments in more detail, it is noted that some example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Specific structural and functional details disclosed herein are merely representative for purposes of describing example embodiments of the present invention. This invention may, however, be embodied in many alternate forms and should not be construed as limited to only the embodiments set forth herein.

Although described with reference to specific examples and drawings, modifications, additions and substitutions of example embodiments may be variously made according to the description by those of ordinary skill in the art. For example, the described techniques may be performed in an order different with that of the methods described, and/or components such as the described system, architecture, devices, circuit, and the like, may be connected or combined to be different from the above-described methods, or results may be appropriately achieved by other components or equivalents.

The pressure trip unit for an electrical switch of at least one embodiment comprises an actuating element and at least one flow channel per electrical pole, wherein the at least one pole of the electrical switch comprises at least two switching contacts for making or disconnecting a flow path, wherein the switching contacts of the at least one pole of the electrical switch are disconnectable by way of the actuating element which can respond to a pressure which is generated in a disconnection zone of the in each case two switching contacts by an electric arc drawn in the event of an electrodynamic recoil of the switching contacts, and wherein the disconnection zone is connectable to the actuating element via the flow channel, wherein the at least one flow channel comprises a nonreturn valve which permits a flow only from the disconnection zone in the direction of the actuating element.

The pressure trip unit according to an embodiment of the invention is optimized for rapid tripping. In terms of its design, it can be constructed compact so that the paths for the compressed air are kept short, which can ensure more rapid tripping. The pressure trip unit according to an embodiment of the invention can be designed as an assembly with integrated nonreturn valves at the interface with the pole cassette.

In one refined embodiment, the nonreturn valves prevent a flow from one disconnection zone to another disconnection zone of the poles of a multi-pole electrical switch.

In a further refined embodiment, the pressure trip unit comprises a common collecting chamber which is arranged between the respective nonreturn valves and the actuating element, wherein the common collecting chamber is arranged in terms of flow at the output of the respective nonreturn valves.

In a further refined embodiment, the nonreturn valve comprises a tongue which, in the inoperative state, covers the flow channel and, in the event of pressure in the associated disconnection zone, opens up the flow channel. The tongue can be manufactured, for example, from aramid. It is advantageous here that aramid is particularly heat-resistant.

In a further refined embodiment, the response behavior of the nonreturn valve is set by the material thickness of the tongue or by the rigidity of the material.

In a further refined embodiment, the pressure trip unit comprises a housing consisting of a first housing part and a second housing part, in which the tongue is held between the first housing part and the second housing part.

In one refined embodiment, the response behavior of the nonreturn valve is set by the angle ($\alpha$) and/or the bending radius of the holding zone of the tongue of the first housing part and the second housing part.

In a further refined embodiment, the actuating element is designed as a tappet. The tappet can be held in an inoperative position by a spring and is actuated in the event of pressure counter to the spring force of the spring.

In one refined embodiment, the pressure trip unit is constructed modularly from at least two valve elements having a respective nonreturn valve and a respective flow channel and also a tripping element with the actuating element, wherein the at least two valve elements and the tripping element are to be able to be plugged together.

In a further refined embodiment, the pressure trip unit comprises closing elements and connecting elements which connect the at least two valve elements and/or the tripping element to one another or close same.

The electrical switch comprising a plurality of poles of at least one embodiment comprises a pressure trip unit according to at least one embodiment of the invention, wherein the plurality of poles of the electrical switch each comprise at least two switching contacts for making or disconnecting a flow path, wherein the switching contacts of the plurality of poles of the electrical switch are disconnected by way of the actuating element which responds to a pressure which is generated in a disconnection zone of the respective two switching contacts by an electric arc drawn in the event of an electrodynamic recoil of the switching contacts, and wherein the disconnection zones are connected to the actuating element via the flow channels.

In one refined embodiment, the electrical switch comprises one, two or three electrical poles, and the pressure trip unit comprises three or four flow channels.

In a further refined embodiment, the electrical switch furthermore comprises a protective barrier which prevents direct transport of particles from the disconnection zone to the pressure trip unit.

FIG. 1 illustrates a pressure trip unit 100 according to an embodiment of the invention for an electrical switch 1000. The pressure trip unit 100 comprises a housing 190 consisting of a first housing part 191 and a second housing part 192. Flow channels 151; 152; 153 which interact with, and are connectable to, disconnection zones 1201; 1202; 1203 of the electrical poles 1101; 1102; 1103 of the electrical switch 1000 are attached to the second housing part 192.

The first housing part 191 and the second housing part 192 of the pressure trip unit 100 can be connected by way of laser beam welding, ultrasonic welding, adhesive bonding or other joining methods in order to ensure as great a gas tightness as possible.

Figure 4:
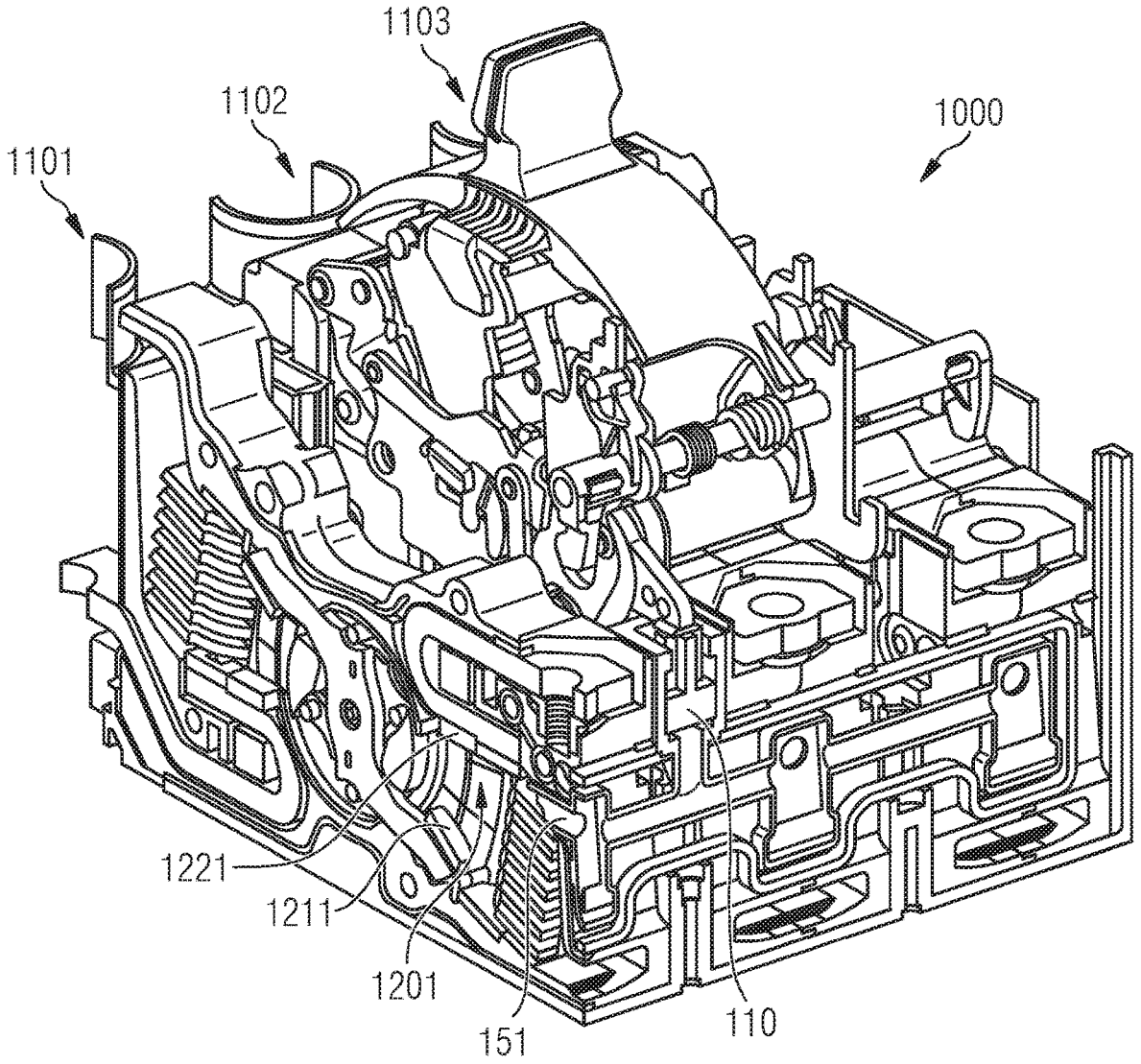
FIG. 4 shows an electrical switch with a plurality of poles and pressure trip unit.

A multi-pole electrical switch 1000 is illustrated in FIG. 4. It comprises a plurality of poles 1101; 1102; 1103 having in each case at least two switching contacts 1211, 1221; 1212, 1222; 1213, 1223 for making or disconnecting a current path. Electrical switches 1000 with two switching contacts (for example, a switching contact pair consisting of a moving contact and a fixed contact) are called single breaking electrical switches, and, in the event of more than two switching contacts (for example, a plurality of switching contact pairs), multiply breaking switches are referred to. The pressure trip unit 100 according to an embodiment of the invention is suitable for single breaking and for multiply breaking electrical switches 1000.

According to FIG. 4, the multi-pole electrical switch 1000 can comprise, for example, three electrical poles 1101; 1102; 1103. The switching contacts 1211, 1221; 1212, 1222; 1213, 1223 of the plurality of poles 1101; 1102; 1103 of the electrical switch 1000 can be disconnected via an actuating element 110 of the pressure trip unit 100, wherein the actuating element 110 can respond to a pressure (p) which is generated in a disconnection zone 1201, 1202, 1203 of the respective two switching contacts 1211, 1221; 1212, 1222; 1213, 1223 by an electric arc (LB) drawn in the event of an electrodynamic recoil of the switching contacts 1211, 1221; 1212, 1222; 1213, 1223. The disconnection zones 1201; 1202; 1203 are connected to the actuating element 110 via the flow channels 151; 152; 153. This means that the pressure (p) which arises in the disconnection zones 1201; 1202; 1203 because of the drawn electric arc (LB) is conducted in terms of flow within the pressure trip unit 100 to the actuating element 110.

Figure 2:
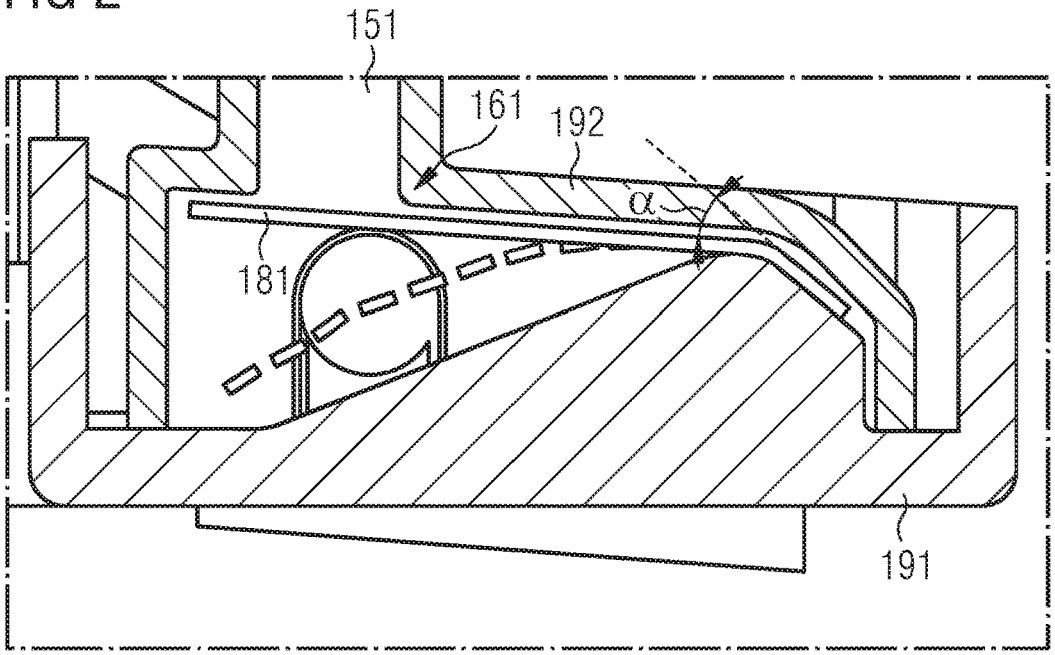
FIG. 2 shows a nonreturn valve with a tongue.

The pressure trip unit 100 furthermore comprises nonreturn valves 161; 162; 163, as illustrated, for example, in FIG. 2. The nonreturn valves 161; 162; 163 are arranged at the respective flow channels 151; 152; 153 and only permit a flow from the respective disconnection zones 1201; 102; 1203 in the direction of the actuating element 110. The nonreturn valves 161; 162; 163 especially serve to prevent a flow being possible from one disconnection zone 1201; 1202; 1203 to another disconnection zone 1201; 1202; 1203 of the poles 1101; 1102; 1103 of the electrical switch 100.

According to FIG. 2, the nonreturn valve 161 comprises a tongue 181 which, in the inoperative state, covers the flow channel 151, as is illustrated in FIG. 2. In the event of a pressure (p) in the disconnection zone 1201 assigned to the flow channel 151, the tongue 181 opens up the flow channel 151 and a flow downward in accordance with FIG. 2 is made possible. Tongue 181 is then located in the position illustrated by dashed lines.

In the event of a pressure surge from an adjacent flow channel 152; 153 and therefore an increase in the pressure below the tongue 181 in accordance with the illustration of FIG. 2, the tongue closes the flow channel 151. This prevents a flow being possible from one disconnection zone 1201; 1202; 1203 to another disconnection zone 1201; 1202; 1203 of the poles 1101; 1102; 1103 of the electrical switch 1000.

FIG. 1 furthermore shows that the pressure trip unit 100 comprises a common collecting chamber 170 which is arranged between the respective nonreturn valves 161; 162; 163 and the actuating element 110.

Figure 3:
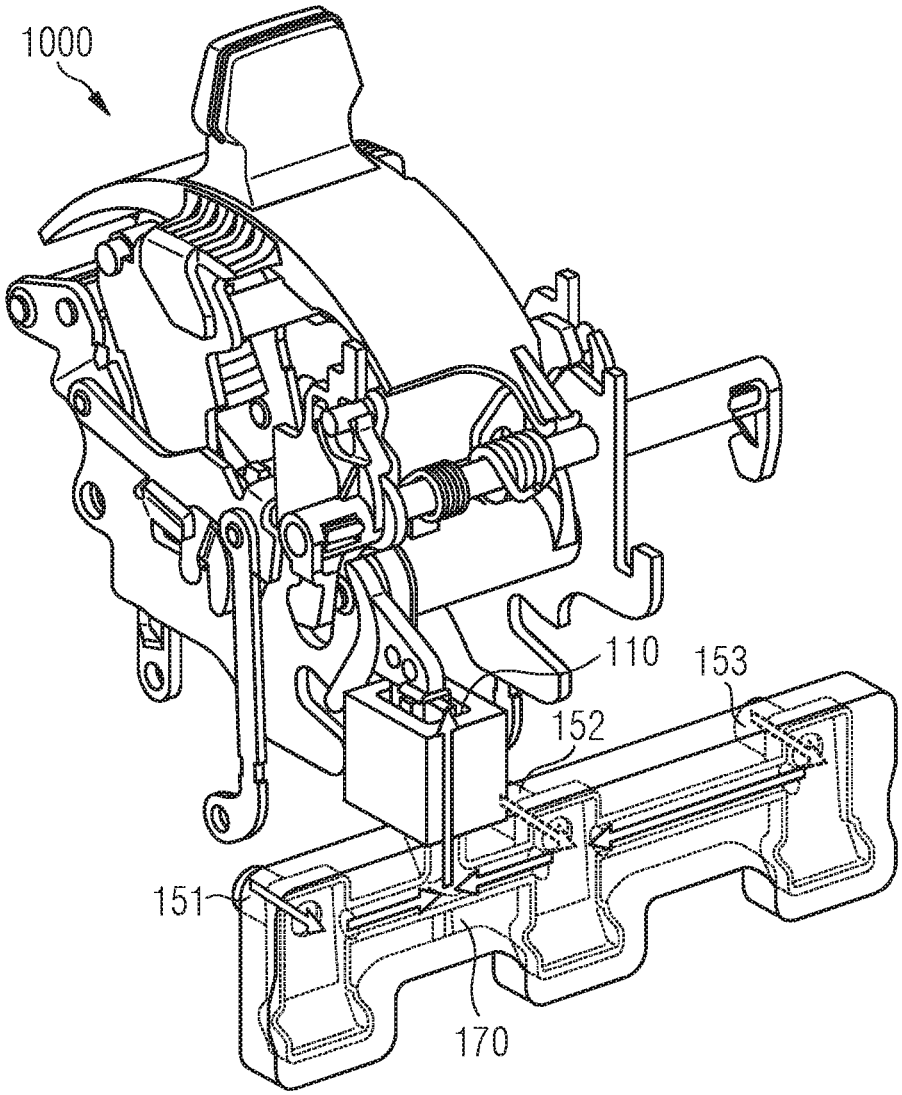
FIG. 3 shows an electrical switch with a pressure trip unit.

This is illustrated in more detail in FIG. 3, in which a flow through the flow channel 151 and through the nonreturn valve 161 located at the end thereof into the common collecting chamber 170 is illustrated. Owing to the increase in pressure in the common collecting chamber 170, the actuating element 110 is deflected upward in accordance with the illustration in FIG. 3 and actuates a tripping lever of the switching lock of the multi-pole electrical switch 1000.

The actuating element 110 can be designed as a tappet for actuating a tripping lever of the switching lock. Furthermore, the actuating element 110 can be provided with suitable structural measures, for example with a spring, and can be held in its inoperative position by the measure. In the event of a pressure (p), the actuating element 110 can be actuated counter to the spring force of the spring. As a result, for example, the response behavior of the pressure trip unit 100 can be set by selection of the spring.

The tongue 181 illustrated in FIG. 2 can be manufactured from an electric-arc-resistant material, for example from aramid. Aramid is a particularly temperature-resistant material which is nevertheless flexible and pliant and permits the flection of the tongue 181 from the inoperative position illustrated in FIG. 2 into the deflected position illustrated by dashed lines. The response behavior of the nonreturn valve 161 can be set by the material thickness of the tongue 181. Similarly, the response behavior can be set by the selection of the material of the tongue 181, on account of the rigidity of the material.

Furthermore, the tongue 181 can be held between the first housing part 191 and the second housing part 192 of the pressure trip unit 100. The holding zone of the tongue 181 can have an angle (α) and/or a bending radius which is formed in the first housing part 191 or second housing part 192 and therefore constitutes a prestressing of the tongue 181 for closing the flow channel 151. The response behavior of the nonreturn valve 161 can likewise be set with the variation of the angle (α) of the holding zone of the tongue 181.

Figure 5:
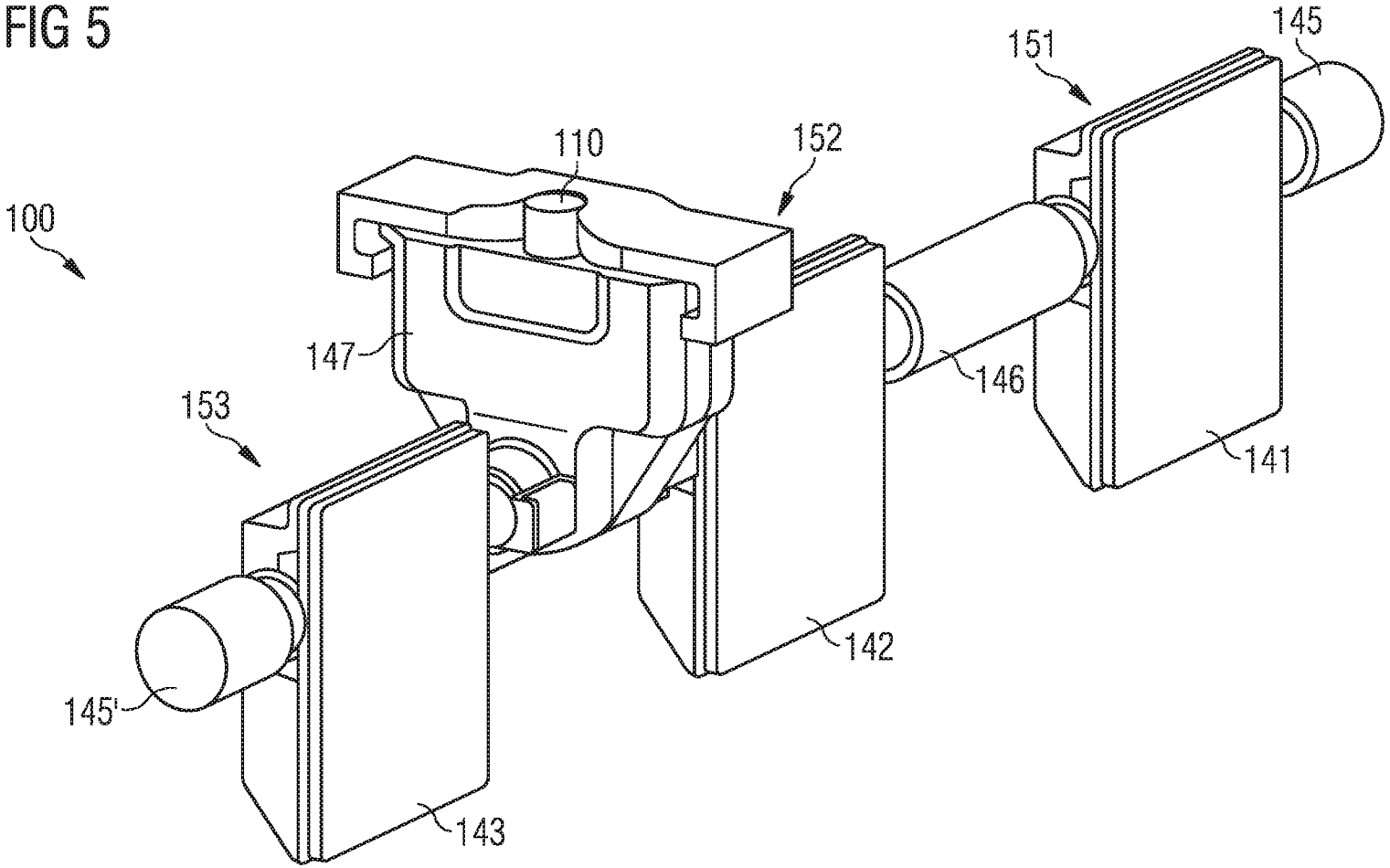
FIG. 5 shows a modular pressure trip unit.

FIG. 5 illustrates a modularly constructed pressure trip unit 100 according to an embodiment of the invention. This comprises valve elements 141; 142; 143 having a respective nonreturn valve 161; 162; 163 and a respective flow channel 151; 152; 153 (not included in the illustration of FIG. 5). Furthermore, the pressure trip unit 100 illustrated in FIG. 5 comprises a tripping element 147 for disconnecting the switching contacts 1211, 1221; 1212, 1222; 1213, 1223. For this purpose, the tripping element 147 is provided with an actuating element 110, for example a tappet. The valve elements 141; 142; 143 and the tripping element 147 are designed here so as to be able to be plugged together.

Furthermore, closing elements 145; 145' and connecting elements 146 are provided for the mechanical construction of the modular pressure trip unit 100. The closing elements 145; 145' and the connecting elements 146 serve for the construction of a pressure trip unit 100 according to an embodiment of the invention which can be plugged together with the valve elements 141; 142; 143 and the tripping element 147.

An advantage of the modular pressure trip unit 100 is that the latter is usable on electrical switches 1000 having a different number of poles 1101; 1102; 1103 and is adaptable thereto. Higher piece numbers of the individual elements, such as the valve elements 141; 142; 143 permit cost-effective manufacturing. A mechanical compensation for tolerances between the phases can likewise be undertaken via the modular pressure trip unit 100.

The closing elements 145; 145', the connecting elements 146, the valve elements 141; 142; 143 and the tripping element 147 can be connected by way of laser beam welding, ultrasonic welding, adhesive bonding or other joining methods in order to ensure as great a gas tightness as possible.

Figure 6A:
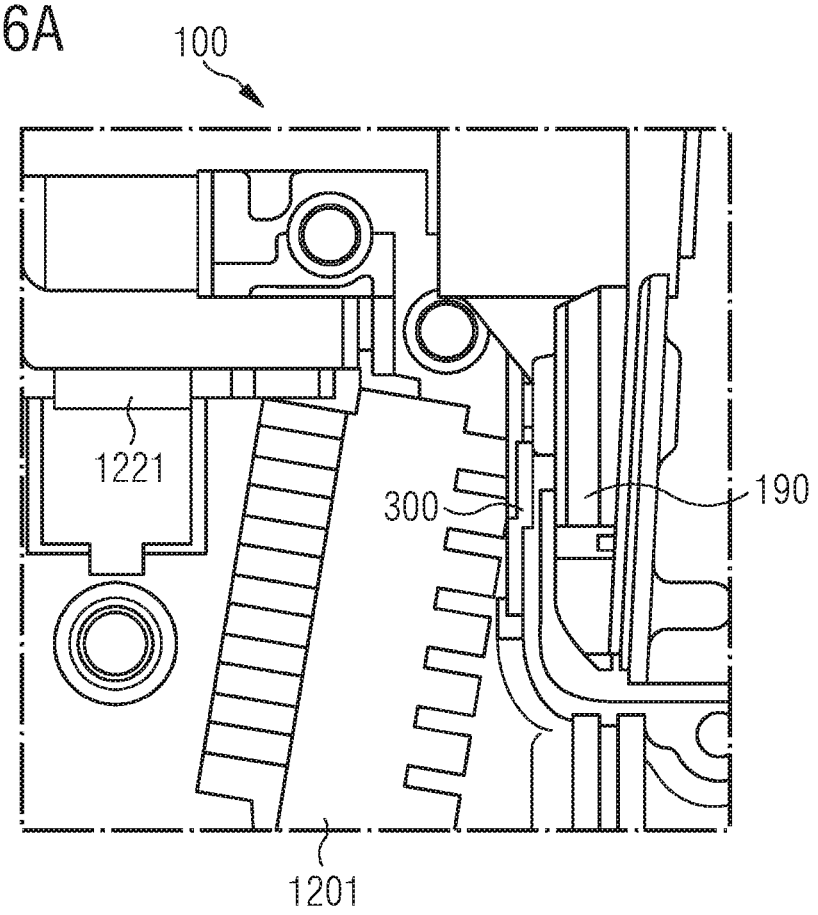
FIGS. 6A and 6B show an electric switch with a pressure trip unit and a protective barrier.
Figure 6B:
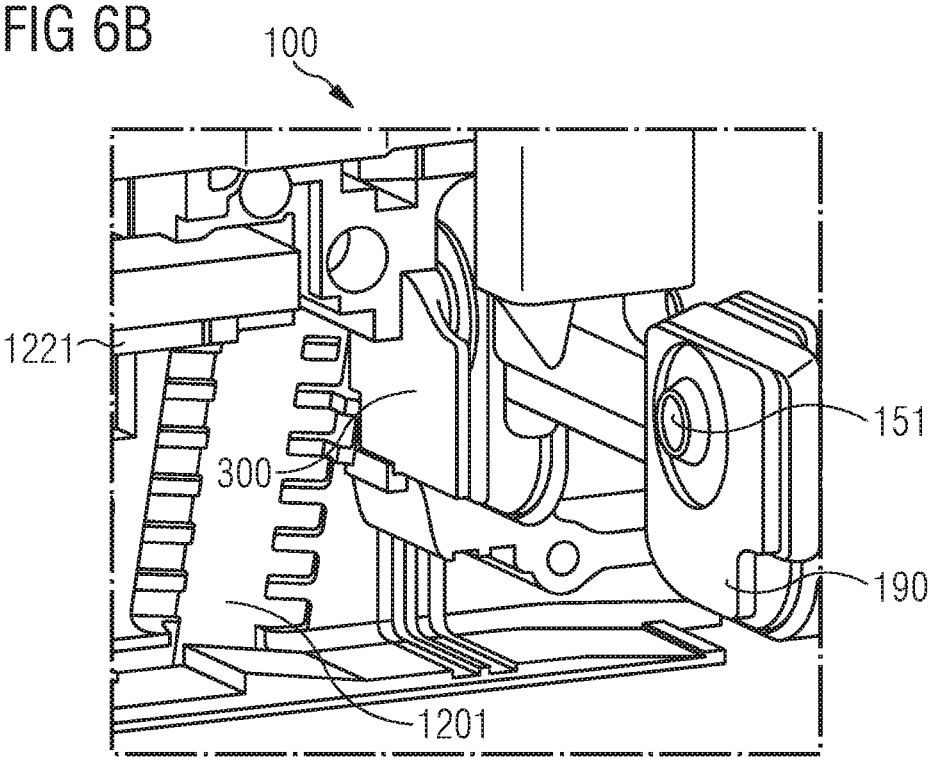
Figure 7:
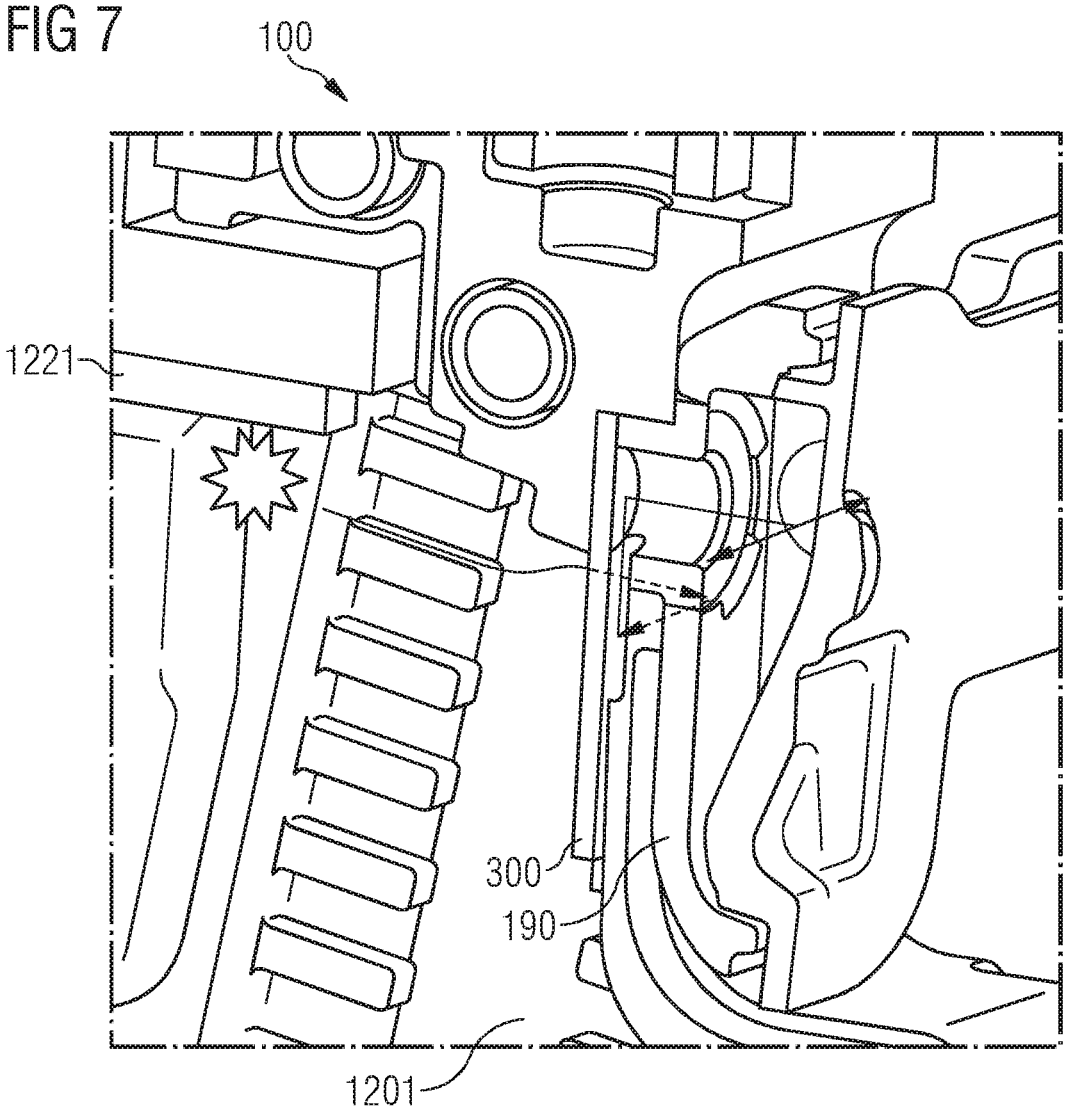
FIG. 7 shows a flow profile in the electrical switch with a pressure trip unit and a protective barrier.

In FIGS. 6A, 6B and 7 the electrical switch 1000 is illustrated with a pressure trip unit 100 according to an embodiment of the invention and a protective barrier 300. The protective barrier 300 prevents the direct transport of particles which are produced in the disconnection zone 1201; 1202; 1203 to the pressure trip unit 100. The protective barrier 300 can be composed of a material reinforced by aramid fibers or glass fibers (e.g. aramid paper).

For this purpose, in accordance with the illustration in FIGS. 6A and 6B, the protective barrier 300 is placed onto the flow channel 151; 152; 153 and prevents direct transport of particles which are produced in the disconnection zone 1201 to the pressure trip unit 100.

The flow profile from the disconnection zone 1201 to the pressure trip unit 100 is illustrated in FIG. 7. The flow passes laterally around the protective barrier 300, and the gas can pass through an opening in the protective barrier 300 into the flow channel 151; 152; 153 and the pressure trip unit 100.

Figure 8A:
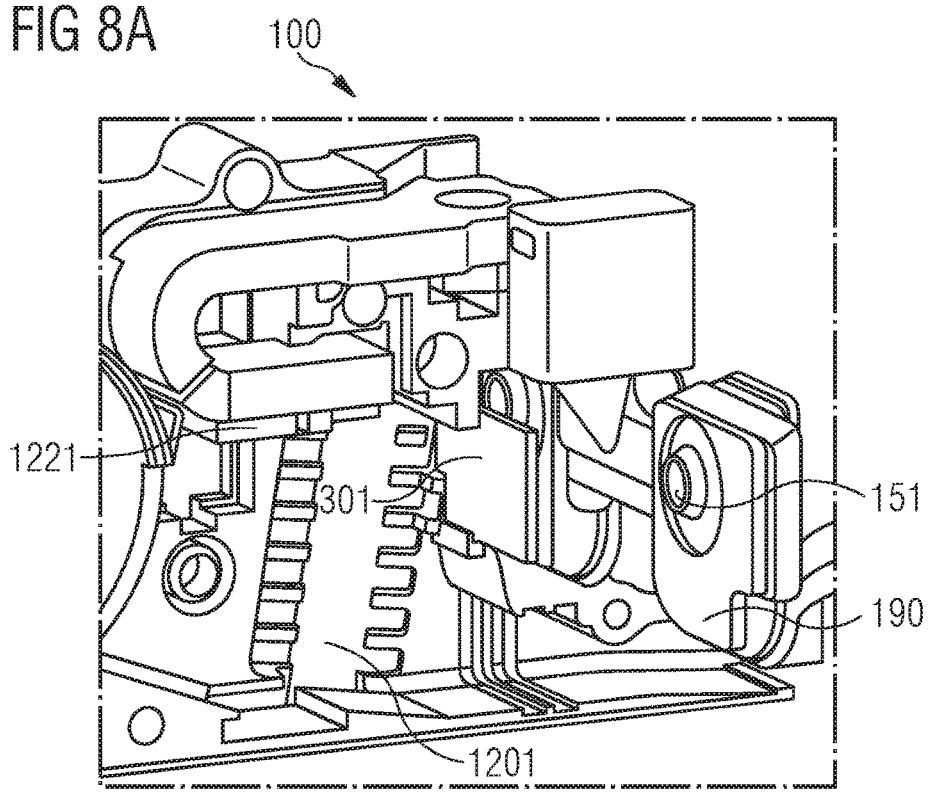
FIGS. 8A and 8B show an electrical switch with a pressure trip unit and an alternative protective barrier.
Figure 8B:
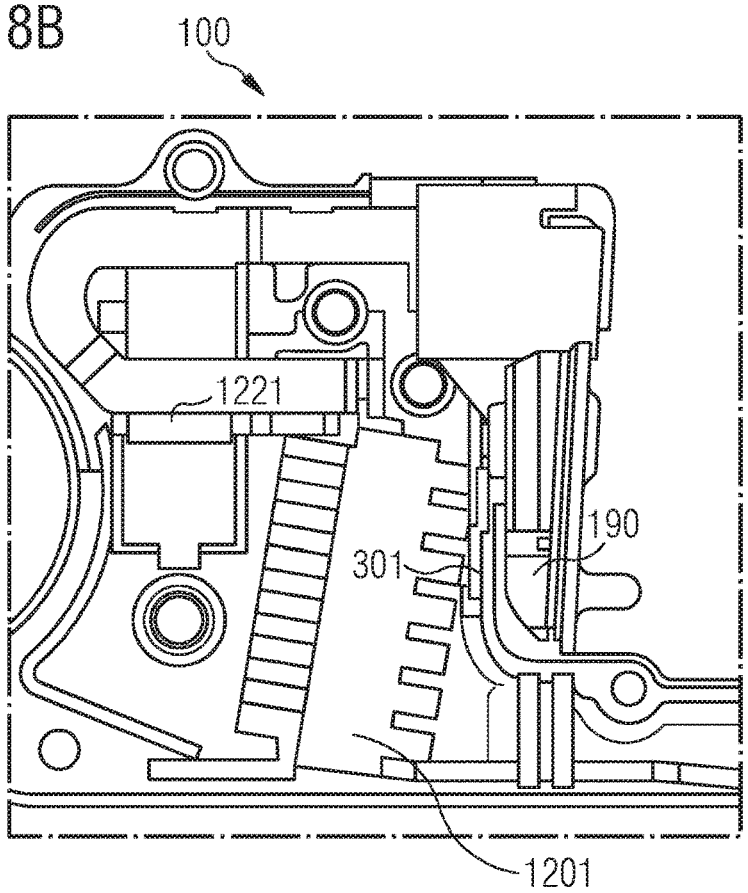
Figure 9:
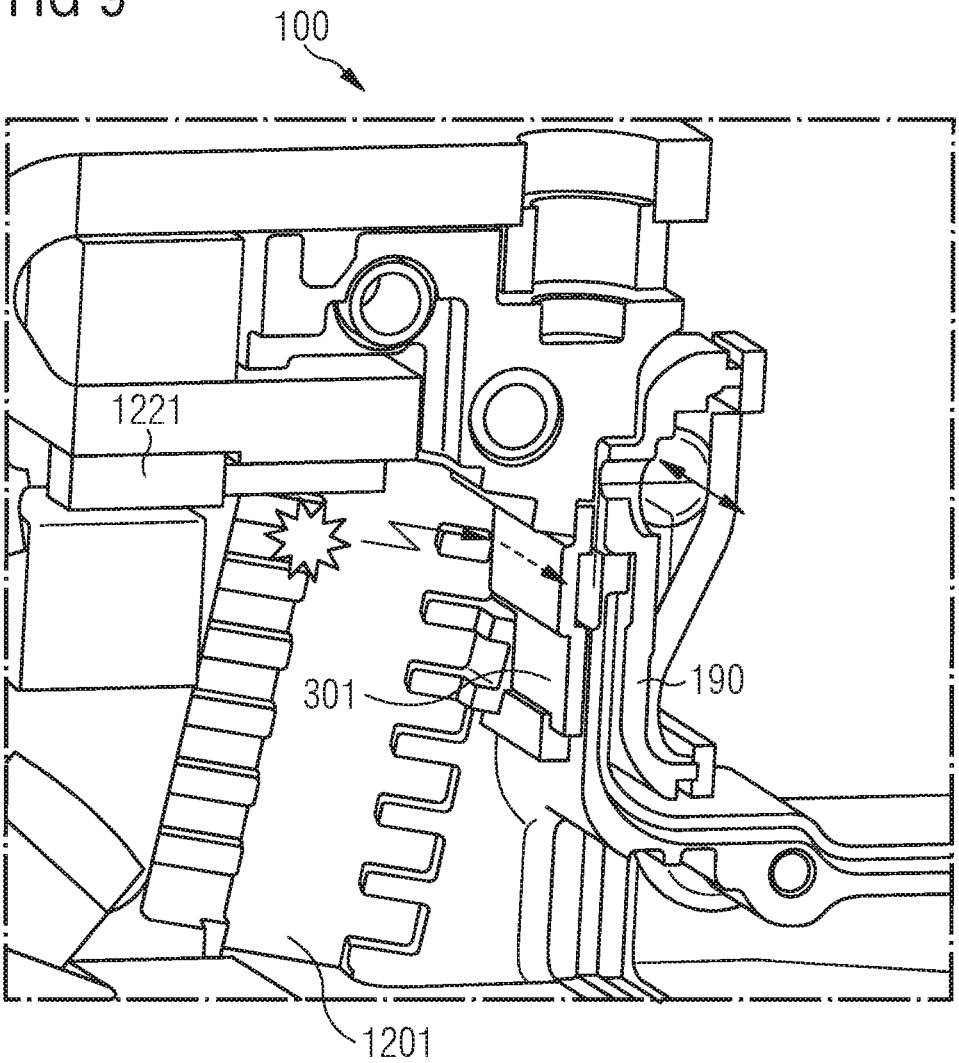
FIG. 9 shows a flow profile in the electrical switch with a pressure trip unit and an alternative protective barrier.

In FIGS. 8A, 8B and 9, the electrical switch 1000 is illustrated with a pressure trip unit 100 according to an embodiment of the invention and an alternative protective barrier 301. The alternative protective barrier 301 prevents the direct transport of particles which are produced in the disconnection zone 1201; 1202; 1203 to the pressure trip unit 100.

For this purpose, in accordance with the illustration in FIGS. 8A and 8B, the protective barrier 301 is held by the housing of the electrical switch 1000 and prevents the direct transport of particles which are produced in the disconnection zone 1201 to the pressure trip unit 100.

The flow profile from the disconnection zone 1201 to the pressure trip unit 100 is illustrated in FIG. 9. The flow passes laterally around the protective barrier 301, and the gas enters the flow channel 151; 152; 153 and the pressure trip unit 100.

Figure 10A:
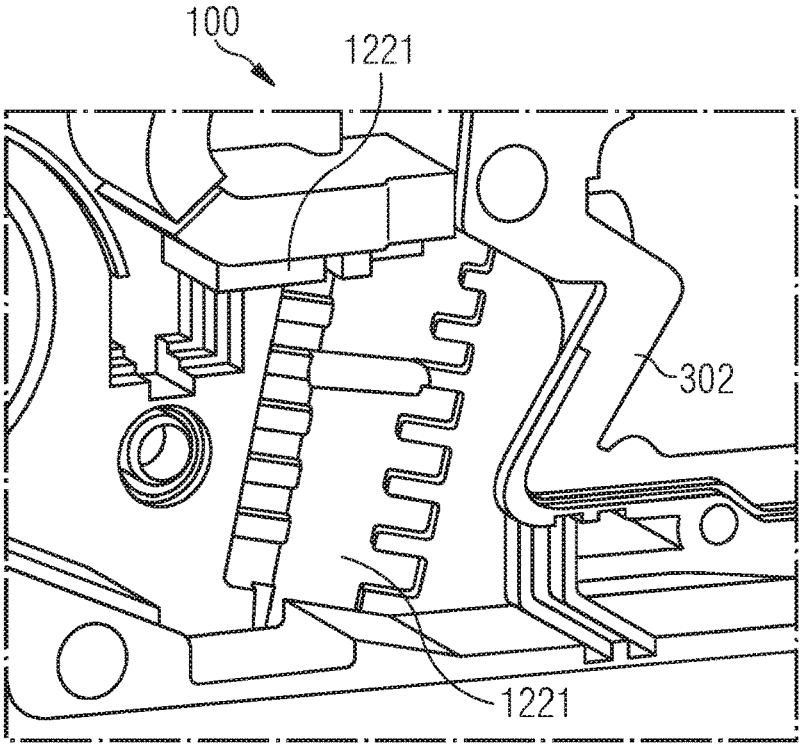
FIGS. 10A and 10B show an electrical switch with a pressure trip unit and a further protective barrier.
Figure 10B:
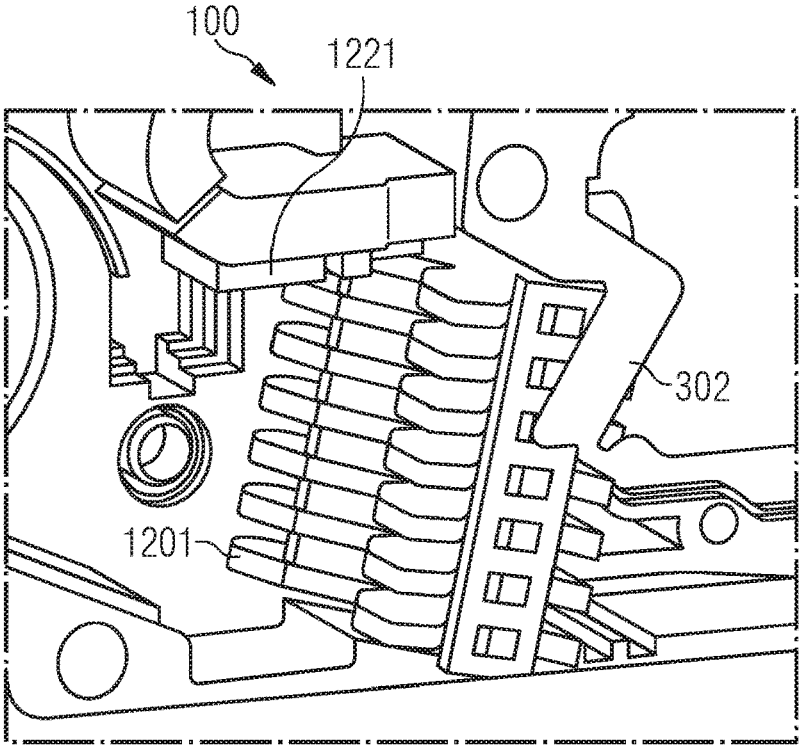

In FIGS. 10A and 10B, the electrical switch 1000 is illustrated with a pressure trip unit 100 according to an embodiment of the invention and a further protective barrier 302. The further protective barrier 302 prevents the direct transport of particles which are produced in the disconnection zone 1201; 1202; 1203 to the pressure trip unit 100.

The pressure trip unit 100 according to an embodiment of the invention is optimized for rapid tripping. The design is constructed compactly, and therefore the paths for the pressure (p) are kept short, which can ensure more rapid tripping. The pressure trip unit 100 is produced as an assembly with integrated nonreturn valves 161; 162; 163 at the interface with the pole cassette. A tappet or actuating element 110 can bring the switching mechanism to tripping.

The positive pressure arising in the event of a short circuit in the pole shells is changed into mechanical force which trips the switching mechanism of the electrical switch 1000.

The patent claims of the application are formulation proposals without prejudice for obtaining more extensive patent protection. The applicant reserves the right to claim even further combinations of features previously disclosed only in the description and/or drawings.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

None of the elements recited in the claims are intended to be a means-plus-function element within the meaning of 35 U.S.C. § 112(f) unless an element is expressly recited using the phrase "means for" or, in the case of a method claim, using the phrases "operation for" or "step for."

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A pressure trip unit for an electrical switch, comprising:

an actuating element;

at least one flow channel, each at least one flow channel respectively corresponding to each of at least one electrical pole of the electrical switch, wherein each at least one pole of the electrical switch includes at least two switching contacts for making or disconnecting a flow path, wherein the at least two switching contacts of each at least one pole of the electrical switch are disconnectable via the actuating element, the actuating element being configured to respond to a pressure generated in a disconnection zone of each respective switching contact of the at least two switching contacts by an electric arc drawn in an event of an electrodynamic recoil of each of the at least two switching contacts, wherein the disconnection zone of each respective switching contact is connectable to the actuating element via the at least one flow channel, the at least one flow channel including a non-return valve to permit a flow only from the disconnection zone in a direction of the actuating element, and wherein the non-return valve of the at least one flow channel includes a tongue, the tongue, in an inoperative state, covering the at least one flow channel and the tongue, in an event of pressure in an associated disconnection zone, being configured to open up the at least one flow channel; and a housing, including a first housing part and a second housing part, the tongue being held between the first housing part and the second housing part, and the tongue being manufactured from aramid, wherein a response behavior of the non-return valve is set by at least one of an angle and a bending radius of a holding zone of the tongue of the first housing part and the second housing part.

2. The pressure trip unit of claim 1, wherein the electrical switch is a multi-pole electrical switch, wherein the at least one pole of the multi-pole electrical switch includes a plurality of poles, and wherein the non-return valve of the at least one flow channel of the multi-pole electrical switch is configured to prevent a flow from one disconnection zone to another disconnection zone of the plurality of poles of the electrical switch.

3. The pressure trip unit of claim 2, further comprising:

a common collecting chamber, wherein the at least one flow channel includes a plurality of flow channels and wherein the non-return valve includes a plurality of non-return valves, the common collecting chamber being arranged between the non-return valves and the actuating element, wherein the common collecting chamber is arranged in terms of flow at an output of the non-return valves.

4. The pressure trip unit of claim 2, wherein the actuating element is designed as a tappet.

5. The pressure trip unit of claim 2, wherein the pressure trip unit is constructed modularly from at least two valve elements, each respective valve element of the at least two valve elements including a respective non-return valve and a respective flow channel; and a tripping element including the actuating element, the at least two valve elements and the tripping element being designed to be pluggable together.

6. An electrical switch, comprising:

a plurality of poles; and the pressure trip unit of claim 2, wherein each of the plurality of poles of the electrical switch comprise at least two switching contacts to make the flow path or disconnect the flow path, wherein the at least two switching contacts of the plurality of poles of the electrical switch are disconnected via the actuating element responding to the pressure generated in the disconnection zone of at least one of the at least two switching contacts by the electric arc drawn in the event of the electrodynamic recoil of the at least two switching contacts, wherein the at least one flow channel of the pressure trip unit includes at least two flow channels, each respective flow channel of the at least two flow channels corresponding to each respective pole of the plurality of poles of the electrical switch, and wherein respective disconnection zones of the at least two switching contacts are connected to the actuating element via the at least two flow channels.

7. The pressure trip unit of claim 1, wherein the response behavior of the non-return valve is set by a material thickness of the tongue or by a rigidity of the material.

8. The pressure trip unit of claim 1, wherein the actuating element is designed as a tappet.

9. The pressure trip unit of claim 8, wherein the tappet is held in an inoperative position by a spring and is actuatable, in an event of pressure, counter to a spring force of the spring.

10. An electrical switch, comprising:

a plurality of poles; and the pressure trip unit of claim 1, wherein each of the plurality of poles of the electrical switch comprise at least two switching contacts to make the flow path or disconnect the flow path, wherein the at least two switching contacts of the plurality of poles of the electrical switch are disconnected via the actuating element responding to the pressure generated in the disconnection zone of at least one of the at least two switching contacts by the electric arc drawn in the event of the electrodynamic recoil of the at least two switching contacts, wherein the at least one flow channel of the pressure trip unit includes at least two flow channels, each respective flow channel of the at least two flow channels corresponding to each respective pole of the plurality of poles of the electrical switch, and wherein respective disconnection zones of the at least two switching contacts are connected to the actuating element via the at least two flow channels.

11. The electrical switch of claim 10, wherein the electrical switch comprises two or three electrical poles, and wherein the pressure trip unit comprises three or four flow channels.

12. The electrical switch of claim 10, wherein the electrical switch further comprises a protective barrier to prevent direct transport of particles from the disconnection zone to the pressure trip unit.

13. A pressure trip unit for an electrical switch, comprising:

an actuating element;

at least one flow channel, each at least one flow channel respectively corresponding to each of at least one electrical pole of the electrical switch, wherein each at least one pole of the electrical switch includes at least two switching contacts for making or disconnecting a flow path, wherein the at least two switching contacts of each at least one pole of the electrical switch are disconnectable via the actuating element, the actuating element being configured to respond to a pressure generated in a disconnection zone of each respective switching contact of the at least two switching contacts by an electric arc drawn in an event of an electrodynamic recoil of each of the at least two switching contacts, wherein the disconnection zone of each respective switching contact is connectable to the actuating element via the at least one flow channel, the at least one flow channel including a non-return valve to permit a flow only from the disconnection zone in a direction of the actuating element, and wherein the non-return valve of the at least one flow channel includes a tongue, the tongue, in an inoperative state, covering the at least one flow channel and the tongue, in an event of pressure in an associated disconnection zone, being configured to open up the at least one flow channel; and a housing, including a first housing part and a second housing part, the tongue being held between the first housing part and the second housing part, and the tongue being manufactured from aramid, wherein the pressure trip unit is constructed modularly from at least two valve elements, each respective valve element of the at least two valve elements including a respective nonreturn valve and a respective flow channel; and a tripping element including the actuating element, the at least two valve elements and the tripping element being designed to be pluggable together.

14. The pressure trip unit of claim 13, wherein the pressure trip unit comprises closing elements and connecting elements to connect or close at least one of the at least two valve elements and the tripping element to one another.

15. The pressure trip unit of claim 13, wherein a response behavior of the non-return valve is set by a material thickness of the tongue or by a rigidity of the material.

16. The pressure trip unit of claim 13, wherein a response behavior of the non-return valve is set by at least one of an angle and a bending radius of a holding zone of the tongue of the first housing part and the second housing part.

17. An electrical switch, comprising:

a plurality of poles; and the pressure trip unit of claim 13, wherein each of the plurality of poles of the electrical switch comprise at least two switching contacts to make the flow path or disconnect the flow path, wherein the at least two switching contacts of the plurality of poles of the electrical switch are disconnected via the actuating element responding to the pressure generated in the disconnection zone of at least one of the at least two switching contacts by the electric arc drawn in the event of the electrodynamic recoil of the at least two switching contacts, wherein the at least one flow channel of the pressure trip unit includes at least two flow channels, each respective flow channel of the at least two flow channels corresponding to each respective pole of the plurality of poles of the electrical switch, and wherein respective disconnection zones of the at least two switching contacts are connected to the actuating element via the at least two flow channels.

18. A pressure trip unit for an electrical switch, comprising:

an actuating element; and at least one flow channel, each at least one flow channel respectively corresponding to each of at least one electrical pole of the electrical switch, wherein each at least one pole of the electrical switch includes at least two switching contacts for making or disconnecting a flow path, wherein the at least two switching contacts of each at least one pole of the electrical switch are disconnectable via the actuating element, the actuating element being configured to respond to a pressure generated in a disconnection zone of each respective switching contact of the at least two switching contacts by an electric arc drawn in an event of an electrodynamic recoil of each of the at least two switching contacts, wherein the disconnection zone of each respective switching contact is connectable to the actuating element via the at least one flow channel, the at least one flow channel including a non-return valve to permit a flow only from the disconnection zone in a direction of the actuating element, and wherein the pressure trip unit is constructed modularly from at least two valve elements, each respective valve element of the at least two valve elements including a respective non-return valve and a respective flow channel; and a tripping element including the actuating element, the at least two valve elements and the tripping element being designed to be pluggable together.

19. The pressure trip unit of claim 18, wherein the pressure trip unit comprises closing elements and connecting elements to connect or close at least one of the at least two valve elements and the tripping element to one another.

20. An electrical switch, comprising:

a plurality of poles; and the pressure trip unit of claim 18, wherein each of the plurality of poles of the electrical switch comprise at least two switching contacts to make the flow path or disconnect the flow path, wherein the at least two switching contacts of the plurality of poles of the electrical switch are disconnected via the actuating element responding to the pressure generated in the disconnection zone of at least one of the at least two switching contacts by the electric arc drawn in an event of the electrodynamic recoil of the at least two switching contacts, wherein the at least one flow channel of the pressure trip unit includes at least two flow channels, each respective flow channel of the at least two flow channels corresponding to each respective pole of the plurality of poles of the electrical switch, and wherein respective disconnection zones of the at least two switching contacts are connected to the actuating element via the at least two flow channels.

* * * * *